US012359359B2

(12) United States Patent
Chong et al.

(10) Patent No.: US 12,359,359 B2
(45) Date of Patent: Jul. 15, 2025

(54) METHOD FOR PERFORMING A SELF-CLEAN CYCLE IN A WASHING MACHINE APPLIANCE

(71) Applicant: Haier US Appliance Solutions, Inc., Wilmington, DE (US)

(72) Inventors: Jinmo Chong, Seoul (KR); MyungGeon Chung, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/355,116

(22) Filed: Jul. 19, 2023

(65) Prior Publication Data

US 2025/0027251 A1 Jan. 23, 2025

(51) Int. Cl.

| | |
|---|---|
| ***D06F 33/43*** | (2020.01) |
| ***D06F 33/42*** | (2020.01) |
| ***D06F 34/22*** | (2020.01) |
| ***D06F 35/00*** | (2006.01) |
| *D06F 103/20* | (2020.01) |
| *D06F 103/70* | (2020.01) |
| *D06F 105/08* | (2020.01) |
| *D06F 105/54* | (2020.01) |

(52) U.S. Cl.

CPC ..... *D06F 33/43* (2020.02); *D06F 34/22* (2020.02); *D06F 35/008* (2013.01); *D06F 33/42* (2020.02); *D06F 2103/20* (2020.02); *D06F 2103/70* (2020.02); *D06F 2105/08* (2020.02); *D06F 2105/54* (2020.02)

(58) Field of Classification Search

CPC ..... D06F 33/43; D06F 33/69; D06F 35/008; D06F 2105/54; B08B 9/08–46

See application file for complete search history.

(56) References Cited

U.S. PATENT DOCUMENTS

| | | | | |
|---|---|---|---|---|
| 11,459,688 | B2 | 10/2022 | Cha et al. | |
| 2010/0287709 | A1* | 11/2010 | Doyle | D06F 33/32 68/12.18 |
| 2020/0018010 | A1* | 1/2020 | Cha | D06F 33/43 |

(Continued)

FOREIGN PATENT DOCUMENTS

| | | | |
|---|---|---|---|
| CN | 105951361 | B | 10/2018 |
| CN | 112962265 | A * | 6/2021 |

(Continued)

*Primary Examiner* — Michael E Barr
*Assistant Examiner* — Richard Z. Zhang
(74) *Attorney, Agent, or Firm* — Dority & Manning, P.A.

(57) ABSTRACT

A washing machine appliance includes a wash tub positioned within a cabinet, a water supply configured to selectively dispense wash fluid into the wash tub, and a conductivity sensor for measuring an electrical conductivity of the wash fluid collected in the wash tub. A controller is configured to receive a request to perform a self-clean cycle, supply a predetermined amount of wash fluid into the wash tub using the water supply, measure an initial conductivity of the wash fluid in the wash tub using the conductivity sensor, measure a final conductivity of the wash fluid in the wash tub a predetermined amount of time after measuring the initial conductivity using the conductivity sensor, determine that the self-clean cycle is needed based at least in part on the initial conductivity and the final conductivity, and perform the self-clean cycle.

20 Claims, 4 Drawing Sheets

(56) References Cited

U.S. PATENT DOCUMENTS

| | | | | |
|---|---|---|---|---|
| 2021/0062397 | A1* | 3/2021 | Cha | D06F 39/02 |
| 2024/0209556 | A1* | 6/2024 | Snook | D06F 37/267 |

FOREIGN PATENT DOCUMENTS

| | | | | |
|---|---|---|---|---|
| CN | 113832653 | A | | 12/2021 |
| KR | 20040046937 | A | * | 6/2004 |
| KR | 100511955 | B1 | | 9/2005 |

* cited by examiner

METHOD FOR PERFORMING A SELF-CLEAN CYCLE IN A WASHING MACHINE APPLIANCE

FIELD OF THE INVENTION

The present subject matter relates generally to washing machine appliances, or more specifically, to self-clean cycles for a washing machine appliance.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

Notably, when the wash or rinse cycle is completed, excess wash fluid commonly collects within the tub, on the wash basket, within the door gasket, on internal surfaces, etc. Because the wash tub is partially or substantially sealed, this wash fluid remains in the tub until the next wash or rinse cycle and the humidity remains relatively constant between cycles. Such collected wash fluid, excessive humidity, and moisture may contribute to mold, mildew, or foul smells. In order to eliminate these issues, conventional appliances include preprogrammed self-clean cycles that are performed to clean the various surfaces and components of the appliance. However, conventional self-clean cycles are performed at regular intervals, regardless of the need for such cleaning, resulting in inefficient energy and water usage. Alternatively, these self-clean cycles are omitted altogether by the appliance user, resulting in build-up, foul smells, and degradation of appliance performance.

Accordingly, a laundry appliance including features and operating methods for initiating self-clean cycles would be desirable. More specifically, a method for initiating a self-clean cycle at desirable times and with minimal user intervention would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a washing machine appliance is provided including a wash tub positioned within a cabinet, a wash basket rotatably mounted within the wash tub and defining a wash chamber configured for receiving a load of clothes, a water supply configured to selectively dispense wash fluid into the wash tub, a conductivity sensor for measuring an electrical conductivity of the wash fluid collected in the wash tub, and a controller operably coupled to the water supply and the conductivity sensor. The controller is configured to receive a request to perform a self-clean cycle, supply a predetermined amount of wash fluid into the wash tub using the water supply, measure an initial conductivity of the wash fluid in the wash tub using the conductivity sensor, measure a final conductivity of the wash fluid in the wash tub a predetermined amount of time after measuring the initial conductivity using the conductivity sensor, determine that the self-clean cycle is needed based at least in part on the initial conductivity and the final conductivity, and perform the self-clean cycle.

In another exemplary embodiment, a method of operating a washing machine appliance is provided. The washing machine appliance includes a wash tub positioned within a cabinet, a wash basket rotatably mounted within the wash tub, a water supply configured to selectively dispense wash fluid into the wash tub, and a conductivity sensor for measuring an electrical conductivity of the wash fluid collected in the wash tub. The method includes receiving a request to perform a self-clean cycle, supplying a predetermined amount of wash fluid into the wash tub using the water supply, measuring an initial conductivity of the wash fluid in the wash tub using the conductivity sensor, measuring a final conductivity of the wash fluid in the wash tub a predetermined amount of time after measuring the initial conductivity using the conductivity sensor, determining that the self-clean cycle is needed based at least in part on the initial conductivity and the final conductivity, and performing the self-clean cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
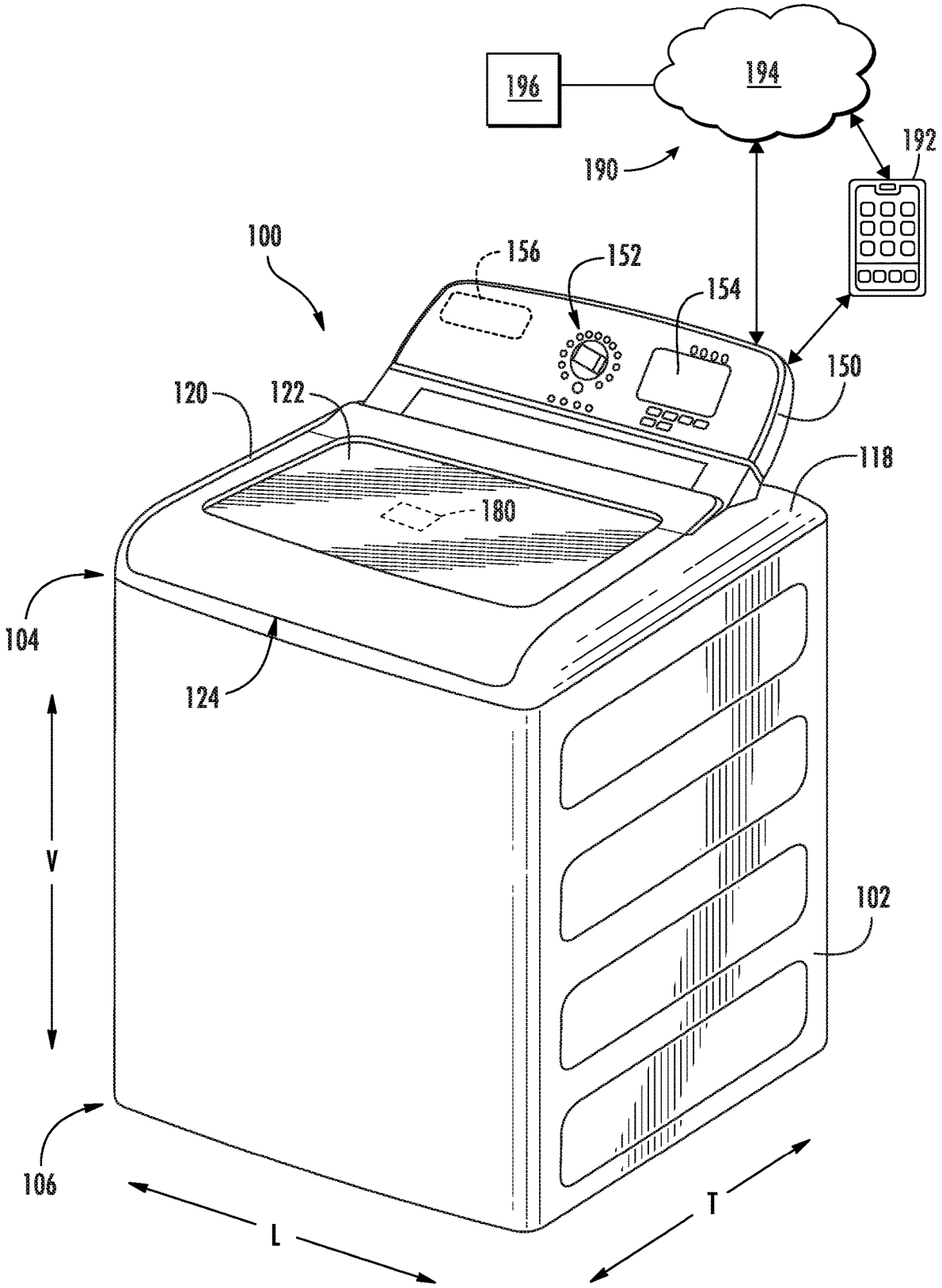
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
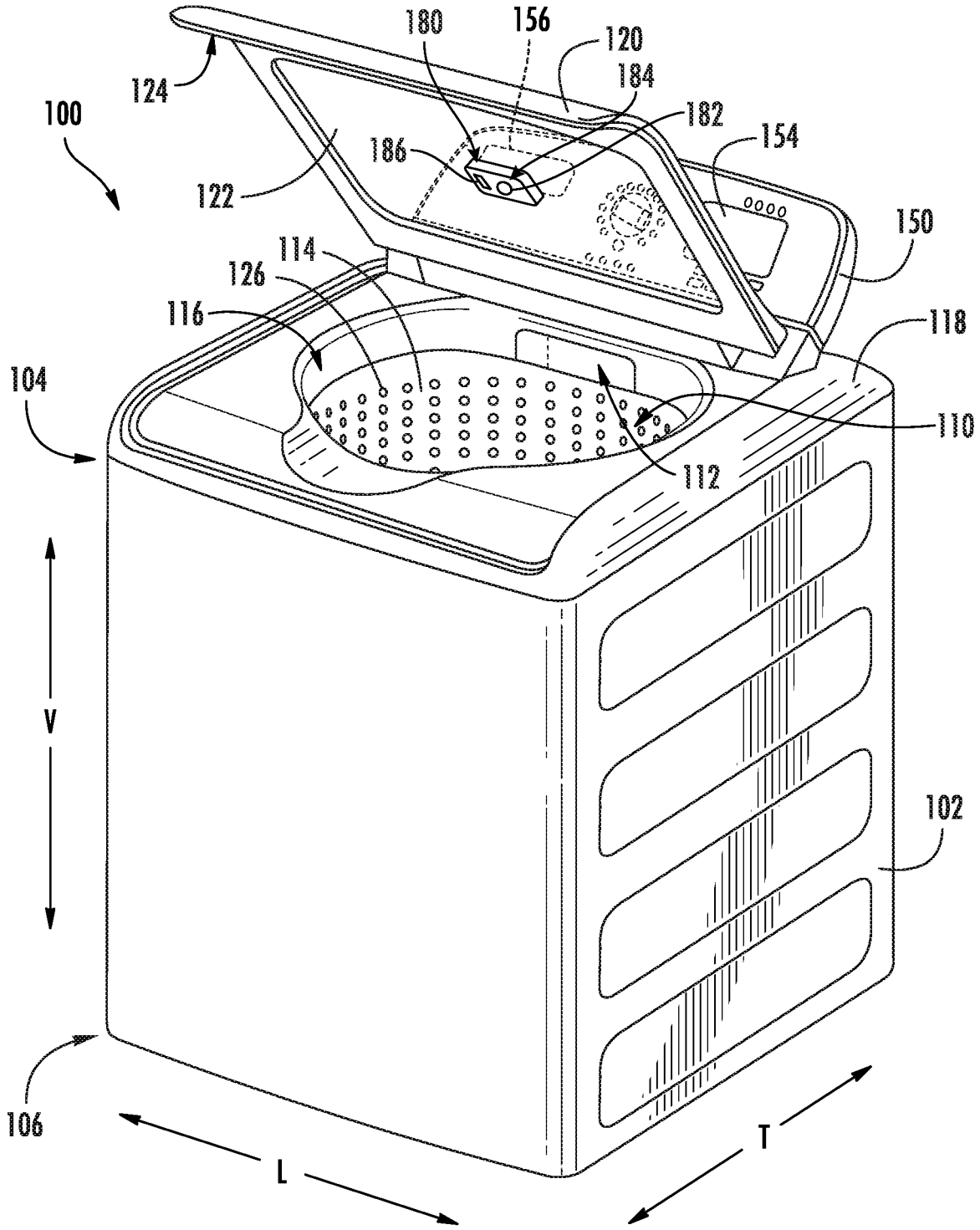
FIG. 2 provides a perspective view of the exemplary washing machine appliance of FIG. 1 with the door of the exemplary washing machine appliance shown in an open position.
Figure 3:
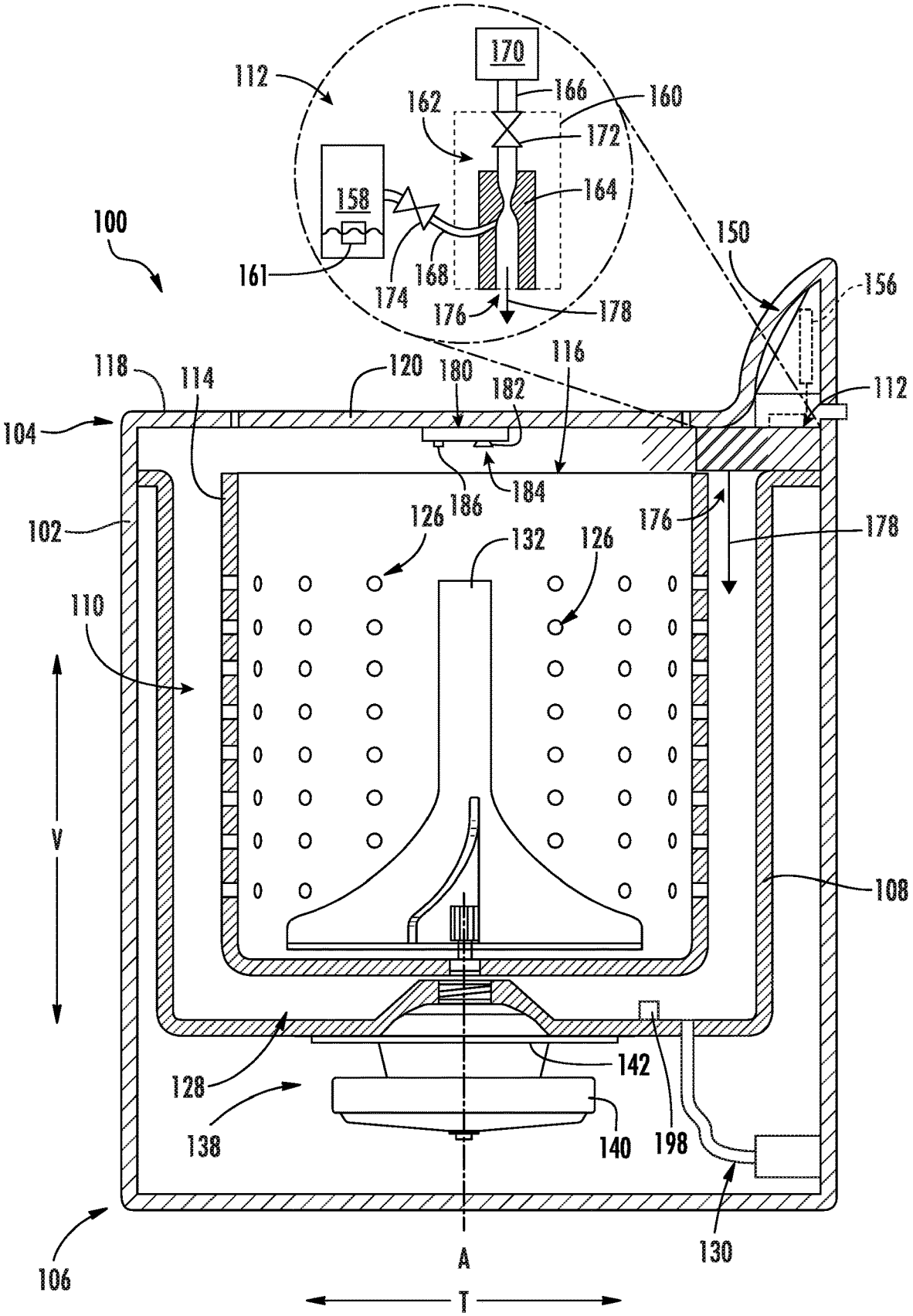
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, and/or other additives, while the wash fluid for a rinse cycle may be water only.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive.

Referring still to FIG. 3, washing machine appliance 100 may further include a one or more tank level sensors 161 that are generally configured for measuring a level or levels of wash additive within bulk reservoir 158. In this regard, for example, tank level sensors 161 may be positioned at multiple heights within bulk reservoir 158 and may be triggered when the level of wash additive falls below a predetermined height (e.g., associated with a specific wash additive volume). For example, washing machine appliance 100 may include tank level sensors 161 that indicate when the level of wash additive is full, low, empty, etc. It should be appreciated that tank level sensors 161 may utilize any suitable technology for measuring fluid levels, e.g., such as float sensors, conductivity sensors, capacitive sensors, mechanical switches, or any other suitable device or technology.

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive. After the target volume of wash additive is dispensed into wash tub 108, additional water may be provided into wash tub 108 as needed to fill to the desired wash volume. It should be appreciated that the target volume may be pre-programmed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additive from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash chamber 108. In this regard, discharge nozzle 176 may be positioned above wash tub proximate a rear of opening 116 defined through top panel 118. Dispensing assembly 112 may be regulated by controller 156 to discharge wash fluid 178 through discharge nozzle 176 at the desired flow rates, volumes, and/or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot and/or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 138 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

Referring now specifically to FIGS. 2 and 3, washing machine appliance 100 may further include a camera assembly 180 that is generally positioned and configured for obtaining images within wash chamber 110 of washing machine appliance 100. Specifically, according to the illustrated embodiment, camera assembly 180 may include a camera 182 mounted to an underside of door 120 of washing machine appliance 100. In this manner, when door 120 is in the closed position, camera 182 may be positioned over wash chamber 110 and may be oriented for obtaining images within wash chamber 110. Specifically, camera 182 is mounted such that it faces toward a bottom side of wash tub 108. In this manner, camera 182 can take unobstructed images or video of an inside of wash chamber 110, e.g., including images of wash basket 114 and discharge nozzle 176.

It should be appreciated that camera assembly 180 may include any suitable number, type, size, and configuration of camera(s) 182 for obtaining images of wash chamber 110. In general, cameras 182 may include a lens 184 that is constructed from a clear hydrophobic material or which may otherwise be positioned behind a hydrophobic clear lens. So positioned, camera assembly 180 may obtain one or more images or videos within wash chamber 110, as described in more detail below. It should be appreciated that other locations for mounting camera assembly 180 are possible, such as below or adjacent a discharge nozzle 176 of washing machine appliance 100.

Referring still to FIGS. 2 through 3, washing machine appliance 100 may further include a tub light 186 that is positioned within cabinet 102 or wash chamber 110 for selectively illuminating wash chamber 110 and the load of clothes positioned therein. Specifically, as shown in FIG. 2, tub light 186 may be integrated into camera assembly 180 and may be positioned immediately adjacent camera 182. According to still other embodiments, tub light 186 may be positioned at any other suitable location within cabinet 102. It should be appreciated that according to alternative embodiments, washing machine appliance 100 may include any other camera or system of imaging devices for obtaining images of the load of clothes or the flow of wash fluid. In addition, these cameras may be positioned at any suitable location within cabinet 102, may include any suitable lighting features, and may utilize any suitable photography or imaging technology.

Notably, controller 156 of washing machine appliance 100 (or any other suitable dedicated controller) may be communicatively coupled to camera assembly 180, tub light 186, and other components of washing machine appliance 100. As explained in more detail below, controller 156 may be programmed or configured for analyzing the images obtained by camera assembly 180, e.g., in order to determine the level of water or wash fluid within wash chamber 110, the additive content of the flow of wash fluid 178, or other cycle information, and may use this information to make informed decisions regarding the operation of washing machine appliance 100.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances and/or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with washing machine appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP. SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

According to example embodiments, washing machine appliance 100 may further include one or more water property sensors, e.g., identified herein as conductivity sensors 198. As best shown in FIG. 3, conductivity sensor 198 may be positioned proximate a bottom of wash tub 108, e.g., to facilitate measurement of the electrical conductivity of wash fluid that collects within wash tub 108. It should be appreciated that washing machine appliance 100 may include other conductivity sensors or systems, and that such systems may incorporate or include any suitable devices or technology for measuring the electrical conductivity of wash fluid.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Now that the construction of washing machine appliance 100 and the configuration of controller 156 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 156 or a separate, dedicated controller.

Figure 4:
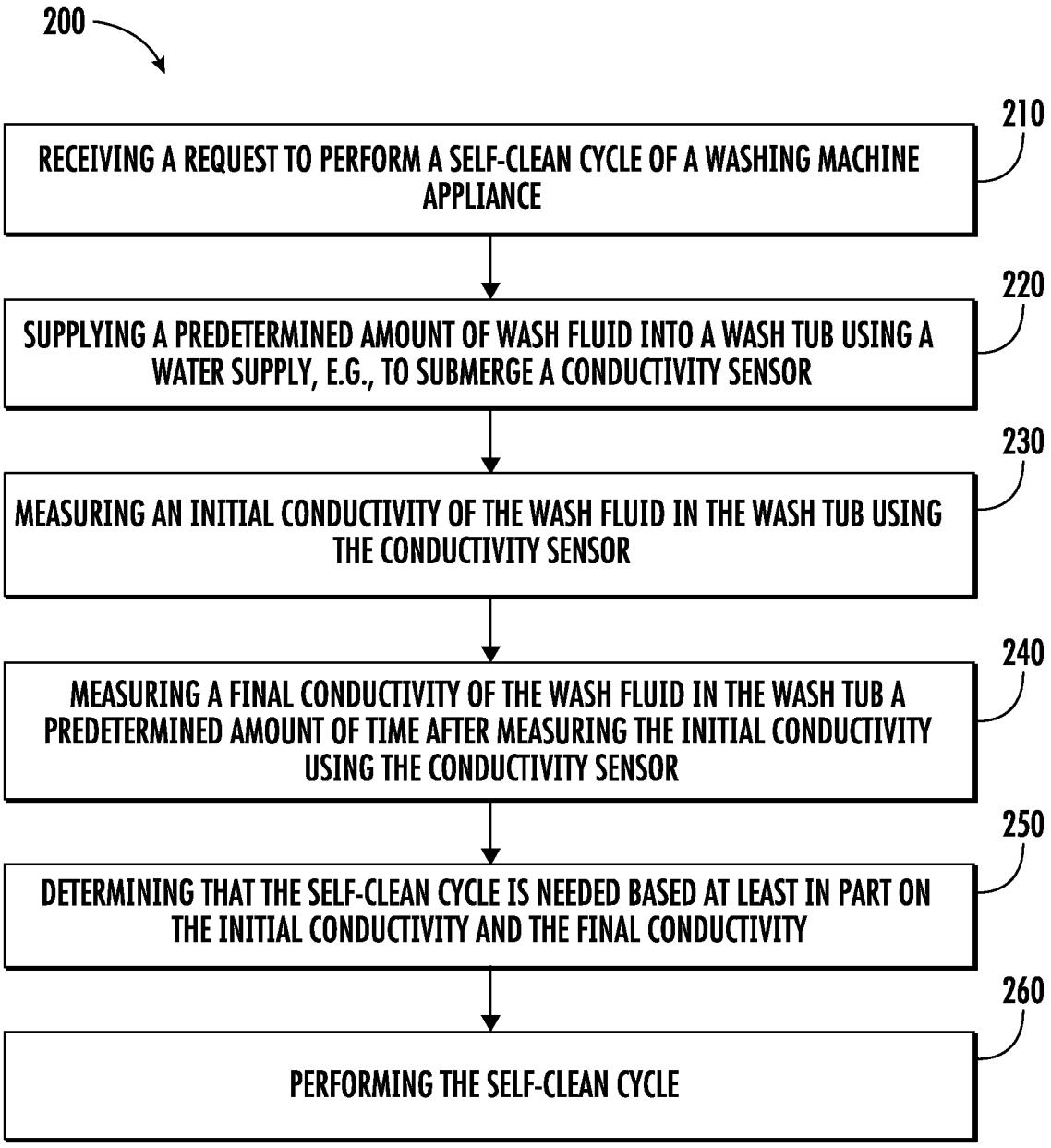
FIG. 4 illustrates a method for operating a washing machine appliance in accordance with one embodiment of the present disclosure.

Referring now to FIG. 4, method 200 includes, at step 210, receiving a request to perform a self-clean cycle of a washing machine appliance. In this regard, as explained above, washing machines may periodically need a self-clean in order to remove the build-up of grime, mold, mildew, and other contaminants. The self-clean request may be an automated request generated by appliance controller 156 or may be a request received from a user, a manufacturer, or another party. According to example embodiments, controller 156 may automatically generate the request to perform the self-clean cycle based on historical operating data of washing machine appliance 100. For example, controller 156 may make such a request based on a number of lapsed cycles or an amount of time that has passed since the most recent self-clean cycle.

According to another exemplary embodiment, the request to perform a self-clean cycle may be received from a user of washing machine appliance 100. In this regard, for example, a user may perceive that a self-clean cycle is needed or may otherwise desire the performance of such a cycle. Control panel 150 may include and input selector 152 through which a user may request the performance of the self-clean cycle. In this regard, for example, the user may press a button to request the self-clean cycle. According to example embodiments, the duration of the button press may be used to determine whether a self-clean cycle is performed regardless of the self-clean verification steps described below with respect to steps 220-250. For example, if a user simply presses and releases the self-cleaning button, this may initiate a self-clean cycle without the performance of the self-clean verification steps described below. By contrast, if the user long presses (e.g., or presses and a holds) the self-clean button, a self-clean verification cycle may be performed to see if a self-clean cycle is in fact needed to clean washing machine appliance 100.

To facilitate the self-cleaning verification cycle, step 220 may include supplying a predetermined amount of wash fluid into a wash tub using a water supply. For example, continuing the example above, primary dispenser 112 may operate to provide a flow of water into wash tub 108. According to example embodiments, the amount of water supplied may be the amount needed to submerge conductivity sensor 198. In addition, the amount of water needed may be intended to at least partially wet a predetermined surface area or portion of wash tub 108 and/or wash basket 114. For example, the predetermined amount of water may be between about 1/10 and 2 gallons, between about 1/5 and 1 gallons, or about 1/2 gallon of water. Other suitable fill quantities are possible and within the scope of the present subject matter.

Step 230 includes measuring an initial conductivity of the wash fluid in the wash tub using the conductivity sensor. In this regard, as soon as the water is supplied into wash tub 108 at step 220, a first conductivity reading is obtained. In general, this first conductivity reading is intended to represent the conductivity of water alone, e.g., water whose conductivity has not been affected by interaction with soil or grime within wash tub 108. As explained in more detail below, the conductivity of the water within wash tub 108 may change over time after interacting with contaminants in wash tub 108. For example, the conductivity of water tends to rise with increasing contamination or soil levels within wash tub (e.g., indicating a larger need for a self-clean cycle).

Step 240 includes measuring a final conductivity of the wash fluid in the wash tub a predetermined amount of time after measuring the initial conductivity using the conductivity sensor. In this regard, step 240 may generally include waiting for a predetermined amount of time and obtaining a second conductivity reading. In general, the predetermined amount of time may be the amount of time needed for the conductivity of the water to change as a result of contaminants within wash tub 108. For example, the predetermined amount of time may be between about 1 minute and 1 2 hours, between about 10 minutes and 1 hour, between about 20 minutes and 40 minutes, or about 30 minutes. Other suitable wait times are possible and within the scope of the present subject matter.

Step 250 includes determining that the self-clean cycle is needed based at least in part on the initial conductivity (e.g., measured at step 230) and the final conductivity (e.g., measured at step 240). In this regard, method 200 may generally include comparing the conductivity change between the initial conductivity (e.g., corresponding to water only) and the final conductivity (e.g., corresponding to a mixture of water and grime within wash tub 108). In general, this difference may be indicative of the level of need for a self-clean cycle. Notably, as explained above, sometimes a self-clean cycle is requested when it is not needed, such that performance of the self-clean cycle at that time may result in wasted energy, water, and detergent. Accordingly, step 250 may generally be a step for verifying whether or not a self-clean cycle is needed.

According to example embodiments, determining that the self-clean cycle is needed based at least in part on the initial conductivity and the final conductivity may include calculating a conductivity difference between the initial conductivity and the final conductivity and determining that the conductivity difference exceeds a predetermined difference threshold. In this regard, the predetermined difference threshold may be measured in siemens, e.g., such as 40, 60, 80, 100, or 120 siemens. According to still other embodiments, determining that the self-clean cycle is needed based at least in part on the initial conductivity and the final conductivity may include determining that there has been a predetermined percentage change of the final conductivity relative to the initial conductivity, e.g., such as 10% change, 20% change, 30% change, 40% change, 50% change, or greater. It should be appreciated that other methods for determining that a self-clean cycle is needed or not needed may be used based on conductivity readings of conductivity sensor 198.

Step 260 includes performing the self-clean cycle in response to determining a self-clean cycle is needed at step 250. As would be understood by one of ordinary skill in the art, the self-clean cycle of a washing machine appliance may generally include the addition of cleaning detergents or additives along with a series of hot water rinses, agitation cycles, etc. in the absence of any clothes within wash chamber 110. Further details regarding the performance of self-clean cycles are omitted here for brevity.

According to example embodiments, method 200 may further include determining that the self-clean cycle is not needed based at least in part on the initial conductivity and the final conductivity. In this regard, for example, if the change in conductivity indicates that the wash tub 108 is not dirty, method 200 may include informing a user that the requested self-clean cycle is not needed. In the event that the self-clean cycle is not needed, washing machine appliance 100 may operate drain pump assembly 130 to discharge the wash fluid from wash tub 108 (e.g., the wash fluid added at step 220). According to example embodiments, a user may still override this determination and request that the self-clean cycle be performed despite the determination that it is not needed. Upon such request (which may be received from the user through control panel 150, external device 192, or in any other suitable manner), washing machine appliance 100 may perform the self-clean cycle.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that this method may be applied to the operation of any suitable laundry appliance, such as another washing machine appliance.

As explained herein, aspects of the present subject matter are generally directed to a method to check cleanliness of an internal drum in a washing machine before starting a self-clean cycle using a conductivity sensor. For example, when a user long presses a self-clean cycle button, the machine may go through a process of checking if it needs to self-clean, e.g., by pouring a small amount of water into the drum to cover the conductivity sensor, which measures the initial conductivity of water. After a predetermined time (e.g., 30 minutes), the conductivity sensor checks the conductivity of the water (consider as final conductivity). If the final conductivity of the water exceeds the initial conductivity of water by a certain value (e.g., 20%), then the washing machine may initiate the self-clean cycle of the drum or else drains the remaining water in the drum. In addition, the user can run the original self-clean cycle by just pressing the self-clean button (if they don't want to check if self-cleaning is needed). This method eliminates the need of periodically running the self-clean cycle without checking if the drum is dirty which leads to a waste of time, detergent, and water.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a wash tub positioned within a cabinet;

a wash basket rotatably mounted within the wash tub and defining a wash chamber configured for receiving a load of clothes;

a water supply configured to selectively dispense wash fluid into the wash tub;

a conductivity sensor for measuring an electrical conductivity of the wash fluid dispensed into the wash tub; and a controller operably coupled to the water supply and the conductivity sensor, the controller being configured to:

receive a request to perform a self-clean cycle;

supply a predetermined amount of wash fluid into the wash tub using the water supply;

measure an initial conductivity of the predetermined amount of wash fluid in the wash tub using the conductivity sensor, the initial conductivity being measured immediately after supplying the predetermined amount of wash fluid;

measure a final conductivity of the predetermined amount of wash fluid in the wash tub a predetermined amount of time after measuring the initial conductivity using the conductivity sensor;

determine that the self-clean cycle is needed based at least in part on the initial conductivity and the final conductivity; and perform the self-clean cycle.

2. The washing machine appliance of claim 1, wherein the predetermined amount of wash fluid is an amount needed to submerge the conductivity sensor.

3. The washing machine appliance of claim 1, wherein the predetermined amount of wash fluid is ½ gallon.

4. The washing machine appliance of claim 1, wherein the predetermined amount of time is between about 10 minutes and 1 hour.

5. The washing machine appliance of claim 1, wherein the predetermined amount of time is about 30 minutes.

6. The washing machine appliance of claim 1, wherein determining that the self-clean cycle is needed based at least in part on the initial conductivity and the final conductivity comprises:

calculating a conductivity difference between the initial conductivity and the final conductivity; and determining that the conductivity difference exceeds a predetermined difference threshold.

7. The washing machine appliance of claim 1, wherein determining that the self-clean cycle is needed based at least in part on the initial conductivity and the final conductivity comprises:

determining that there has been a 20% change of the final conductivity relative to the initial conductivity.

8. The washing machine appliance of claim 1, wherein determining that the self-clean cycle is needed based at least in part on the initial conductivity and the final conductivity comprises:

determining that there has been a 40% change of the final conductivity relative to the initial conductivity.

9. The washing machine appliance of claim 1, wherein the controller is further configured to:

determine that the self-clean cycle is not needed based at least in part on the initial conductivity and the final conductivity;

receive a request to perform the self-clean cycle despite the determination that the self-clean cycle is not needed; and perform the self-clean cycle.

10. The washing machine appliance of claim 1, further comprising a drain pump assembly for draining wash fluid from the wash tub, and wherein the controller is further configured to:

determine that the self-clean cycle is not needed based at least in part on the initial conductivity and the final conductivity; and operate the drain pump assembly to drain the predetermined amount of wash fluid from the wash tub.

11. The washing machine appliance of claim 1, wherein the request to perform the self-clean cycle is provided by the controller based on a number of lapsed cycles or an amount of time that has passed since a last self-clean cycle.

12. The washing machine appliance of claim 1, wherein receiving the request to perform the self-clean cycle comprises receiving a long press of a self-clean button.

13. The washing machine appliance of claim 1, wherein the conductivity sensor is positioned within a sump of the wash tub.

14. The washing machine appliance of claim 1, wherein the washing machine appliance is a vertical axis washing machine appliance.

15. A method of operating a washing machine appliance, the washing machine appliance comprising a wash tub positioned within a cabinet, a wash basket rotatably mounted within the wash tub, a water supply configured to selectively dispense wash fluid into the wash tub, . . . and a conductivity sensor for measuring an electrical conductivity of the wash fluid dispensed into the wash tub . . . , the method comprising:

receiving a request to perform a self-clean cycle;

supplying a predetermined amount of wash fluid into the wash tub using the water supply;

measuring an initial conductivity of the predetermined amount of wash fluid in the wash tub using the conductivity sensor, the initial conductivity being measured immediately after supplying the predetermined amount of wash fluid;

measuring a final conductivity of the predetermined amount of wash fluid in the wash tub a predetermined amount of time after measuring the initial conductivity using the conductivity sensor;

determining that the self-clean cycle is needed based at least in part on the initial conductivity and the final conductivity; and performing the self-clean cycle.

16. The method of claim 15, wherein the predetermined amount of time is about 30 minutes.

17. The method of claim 15, wherein determining that the self-clean cycle is needed based at least in part on the initial conductivity and the final conductivity comprises:

calculating a conductivity difference between the initial conductivity and the final conductivity; and determining that the conductivity difference exceeds a predetermined difference threshold.

18. The method of claim 15, wherein determining that the self-clean cycle is needed based at least in part on the initial conductivity and the final conductivity comprises:

determining that there has been a 20% change of the final conductivity relative to the initial conductivity.

19. The method of claim 15, further comprising:

determine that the self-clean cycle is not needed based at least in part on the initial conductivity and the final conductivity;

receive a request to perform the self-clean cycle despite the determination that the self-clean cycle is not needed; and perform the self-clean cycle.

20. The method of claim 15, further comprising:

determine that the self-clean cycle is not needed based at least in part on the initial conductivity and the final conductivity; and operate a drain pump assembly to drain the predetermined amount of wash fluid from the wash tub.

* * * * *